US009689131B2

(12) United States Patent
Taomoto et al.

(10) Patent No.: US 9,689,131 B2
(45) Date of Patent: Jun. 27, 2017

(54) WATER COLLECTING STRUCTURE

(71) Applicant: PANASONIC CORPORATION, Osaka (JP)

(72) Inventors: Akira Taomoto, Kyoto (JP); Yumi Wakita, Nara (JP); Junichiro Takeuchi, Kyoto (JP); Koichi Unami, Kyoto (JP); Toshihiko Kawachi, Kyoto (JP)

(73) Assignee: PANASONIC CORPORATION, Osaka (JP)

( * ) Notice: Subject to any disclaimer, the term of this patent is extended or adjusted under 35 U.S.C. 154(b) by 357 days.

(21) Appl. No.: 14/445,449

(22) Filed: Jul. 29, 2014

(65) Prior Publication Data

US 2014/0334877 A1 Nov. 13, 2014

Related U.S. Application Data

(63) Continuation of application No. PCT/JP2013/005540, filed on Sep. 19, 2013.

(30) Foreign Application Priority Data

Sep. 25, 2012 (JP) ..... 2012-210805

(51) Int. Cl.
*A01G 25/06* (2006.01)
*E02D 3/10* (2006.01)
(Continued)

(52) U.S. Cl.
CPC ..... *E02B 11/00* (2013.01); *E02D 17/20* (2013.01)

(58) Field of Classification Search
CPC . E02D 19/16; E02B 3/108; E02B 3/00; E02B 15/04
(Continued)

(56) References Cited

U.S. PATENT DOCUMENTS 2,164,003 A * 6/1939 Scheelhaase ..... E02D 29/077 405/137
3,580,883 A * 5/1971 Adachi ..... C09K 17/20 405/264
(Continued)

FOREIGN PATENT DOCUMENTS

JP 54-158006 A 12/1979
JP 57-205604 A 12/1982
(Continued)

OTHER PUBLICATIONS

International Preliminary Report on Patentability issued in corresponding International Patent Application No. PCT/JP2013/005540, mailed on Apr. 9, 2015; 7 pages in English language.
(Continued)

*Primary Examiner* — Benjamin Fiorello
*Assistant Examiner* — Edwin Toledo-Duran
(74) *Attorney, Agent, or Firm* — McDermott Will & Emery LLP

(57) ABSTRACT

A water repellent sand layer that is made of water repellent sand and serves as a water shield layer is provided to be slanted between upper and lower soil layers, a water conveying belt portion is provided to include at least one or both of gravel and a culvert that are provided between the water repellent sand layer and the upper soil layer, and a water shield wall is provided at a slant downstream side. Water falling and permeating from a ground surface into the soil layer is blocked by the water repellent sand layer, flows downward in the water conveying belt portion located above the water repellent sand layer to the slant downstream side, and is blocked by the water shield wall at the slant downstream side, so that the collected water is recovered from a drain hole in the culvert that penetrates the water shield wall.

18 Claims, 9 Drawing Sheets

(51) Int. Cl.
*E02B 11/00* (2006.01)
*E02D 17/20* (2006.01)

(58) Field of Classification Search
USPC ..... 405/263, 107, 80, 36–51; 210/170.01–170.11
See application file for complete search history.

(56) References Cited

U.S. PATENT DOCUMENTS 3,837,168 A * 9/1974 Alsberg ..... E03F 1/002 404/4
4,596,491 A * 6/1986 Dietzler ..... E02B 11/00 138/115
4,650,367 A * 3/1987 Dietzler ..... E02B 11/00 138/172
5,002,427 A * 3/1991 Kambe ..... C09K 17/00 405/36
5,322,629 A * 6/1994 Stewart ..... B01D 24/002 210/170.03
5,393,312 A 2/1995 Ogawa et al.
5,472,458 A * 12/1995 Ogawa ..... A01G 9/1086 405/263
5,520,480 A * 5/1996 Ohsaki ..... C09K 17/38 106/2
5,580,192 A 12/1996 Ogawa et al.
5,823,711 A * 10/1998 Herd ..... E02B 11/005 405/36
5,836,716 A * 11/1998 Johnson ..... E02B 11/005 405/43
6,461,078 B1 * 10/2002 Presby ..... B01D 29/23 138/105
6,505,996 B1 * 1/2003 Ianniello ..... E01F 5/00 404/2
7,309,188 B2 * 12/2007 Ianniello ..... E01C 3/00 210/170.08
2003/0092531 A1 * 5/2003 Daluise ..... A63C 19/04 482/1
2004/0195182 A1 * 10/2004 Elliott ..... B01J 20/26 210/681
2007/0094952 A1 * 5/2007 Niemczyk ..... E02D 31/02 52/169.5
2009/0261036 A1 * 10/2009 Lucas ..... C02F 1/004 210/602

FOREIGN PATENT DOCUMENTS

JP 4-088930 A 3/1992
JP 6-113673 A 4/1994
JP 2909858 B2 6/1999
JP 2909860 B2 6/1999
JP 3076024 B2 8/2000
JP 2002-054152 A 2/2002
JP 2003-293352 A 10/2003
JP 2011-094448 A 5/2011

OTHER PUBLICATIONS

International Search Report dated Dec. 17, 2013 issued in International Patent Application No. PCT/JP2013/005540.

* cited by examiner

WATER COLLECTING STRUCTURE

CROSS-REFERENCE TO RELATED APPLICATIONS

This is a continuation application of International Application No. PCT/JP2013/005540, with an international filing date of Sep. 19, 2013, which claims priority of Japanese Patent Application No. 2012-210805 filed on Sep. 25, 2012, the content of which is incorporated herein by reference.

TECHNICAL FIELD

The technical field relates to a water collecting structure capable of efficiently recovering water that falls and permeates in a soil layer.

BACKGROUND ART

Water permeating underground is artificially recovered and reused so that the valuable water resource is effectively utilized mainly in a region with small rainfall. A conventional water collecting system includes a waterproof sheet or the like for recovering and storing rainwater falling or irrigation water supplied onto a ground surface of farmland or the like using a slanted water shield layer.

For example, Patent Literature 1 discloses a system including a water shield layer, for collecting and supplying water using the slanted water shield layer. Patent Literature 2 discloses providing a slanted bottom wall and a side wall that are made of a water shield material and limiting a water flow path so as to allow water to flow in slanted soil and improve water clarification. According to Patent Literature 1 and Patent Literature 2, the water shield layer is configured by a waterproof sheet or the like, which is broken due to vibration in civil engineering or ground change by an earthquake or the like, and cannot be self-repaired.

Meanwhile, Patent Literature 3 discloses a soil structure that includes a hydrophobic layer made of hydrophobic particles in soil located at a predetermined depth from a ground surface, in order to suppress the amount of evaporation in the soil and control the amount of water in the soil. The hydrophobic layer made of hydrophobic particles is provided in the soil structure so as to suppress evaporation in the soil. Patent Literature 4 discloses providing a water repellent layer made of water repellent particles in or below soil used for plant cultivation so as to suppress capillary rise of ground water and prevent salt damage.

CITATION LIST

Patent Literatures

PATENT LITERATURE 1: Japanese Unexamined Patent Publication No. 04-88930 A

PATENT LITERATURE 2: Japanese Patent Publication No. 3076024 B1

PATENT LITERATURE 3: Japanese Patent Publication No. 2909860 B1

PATENT LITERATURE 4: Japanese Patent Publication No. 2909858 B1

SUMMARY OF THE INVENTION

A conventional water collecting system includes a waterproof sheet or the like for recovering and storing rainwater falling or irrigation water supplied onto a ground surface of farmland or the like using a slanted water shield layer. The waterproof sheet loses the water shield property when the waterproof sheet is broken due to aging deterioration, a load or vibration of a heavy machine in civil engineering or farm work, or ground change by an earthquake or the like.

In view of the above, one non-limiting and exemplary embodiment provides a water collecting structure that is unlikely to be broken by civil engineering or the like and is capable of efficiently recovering falling and permeating water.

Additional benefits and advantages of the disclosed embodiments will be apparent from the specification and Figures. The benefits and/or advantages may be individually provided by the various embodiments and features of the specification and drawings disclosure, and need not all be provided in order to obtain one or more of the same.

In one general aspect, the techniques disclosed here feature: A water collecting structure for collecting water from an upstream side to a downstream side between a first soil layer and a second soil layer located below the first soil layer, the structure comprising:

a water repellent sand layer that is provided on the second soil layer, has an upper surface slanted downward from an upstream side thereof to a downstream side thereof, and is made of a plurality of particles to which water repellent treatment is applied;

a water conveying belt portion including a gravel layer and a culvert, the gravel layer being located on the upper surface of the water repellent sand layer so as to be slanted downward from an upstream-side end to a downstream-side end and being made of a plurality of gravel particles larger in diameter than the plurality of particles with the water repellent treatment of the water repellent sand layer, the culvert being located between the water repellent sand layer and the first soil layer and being provided therein with a drain hole that is slanted downward from an upstream-side end thereof to a downstream-side end thereof, the water conveying belt portion being located on the upper surface of the water repellent sand layer and below the first soil layer and allowing water flowing from the first soil layer into the gravel layer or the drain hole in the culvert to flow from an upstream-side end of the water conveying belt portion to a downstream-side end of the water conveying belt portion;

a water shield wall that is provided to surround at least the downstream-side end of the water conveying belt portion and has a through hole that the culvert penetrates; and a reservoir that stores water discharged from the drain hole in the culvert that penetrates the through hole in the water shield wall.

These general and specific aspects may be implemented using a system, a method, and a computer program, and any combination of systems, methods, and computer programs.

In comparison to a case where a water shield layer is configured by a waterproof sheet or the like, the water collecting structure according to the aspect of the present invention includes the water repellent sand so as to exert the effect that the structure is unlikely to be broken due to a load or vibration of a heavy machine in civil engineering or farm work, or ground change by an earthquake or the like. Water falling and permeating in the first soil layer is stored on the upper surface of the water repellent sand layer and flows into the water conveying belt portion on the upper surface of the water repellent sand layer. The water conveying belt portion is located to be slanted downward from the upstream-side end to the downstream-side end. The water flown into the water conveying belt portion flows in the drain hole in the culvert to the downstream-side end and is discharged from the drain hole in the culvert that penetrates the water shield wall, so as to be stored in the reservoir. It is thus possible to efficiently recover the water falling and permeating in the soil layer.

BRIEF DESCRIPTION OF DRAWINGS

These and other aspects and features of the present invention will become clear from the following description taken in conjunction with the embodiments thereof with reference to the accompanying drawings, in which.

DETAILED DESCRIPTION

Figure 1A:
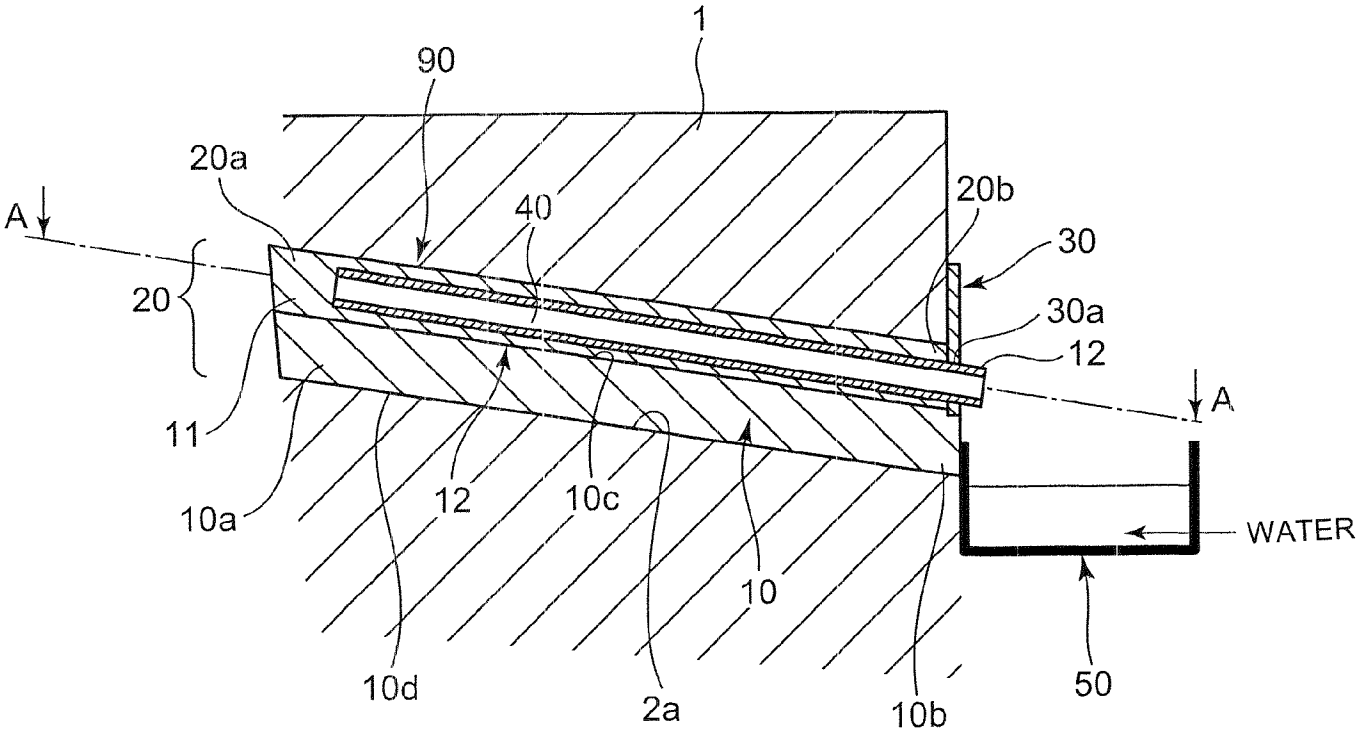
FIG. 1A is a vertical section side view of a water collecting structure according to an embodiment of the present invention, the water collecting structure including a slanted water shield layer made of water repellent sand between upper and lower soil layers, a water conveying belt portion including at least one or both of a gravel layer and a culvert provided between a water repellent sand layer and the upper soil layer, and a water shield wall at a downstream-side end of the slant, so that water permeating in the upper soil layer flows in the slanted water conveying belt portion and is collected from a drain hole provided in the water shield wall so as to be connected to the downstream-side end of the water conveying belt portion.

Before continuing the description of the present disclosure, it is noted that the same components are denoted by the same reference signs in the accompanying drawings.

Initially described is finding by the present inventors as the basis of the present disclosure, obtained through research of the conventional techniques.

A conventional water collecting system includes a waterproof sheet or the like for recovering and storing rainwater falling or irrigation water supplied onto a ground surface of farmland or the like using a slanted water shield layer. The waterproof sheet loses the water shield property when the waterproof sheet is broken due to aging deterioration, a load or vibration of a heavy machine in civil engineering or farm work, or ground change by an earthquake or the like. Furthermore, it is difficult to specify a broken location. Restoration of the waterproof sheet thus requires relatively large scale civil engineering. According to the method of controlling the amount of water in soil or preventing salt damage using water repellent particles, it is possible to shield vertical movement of water using the layer made of the water repellent particles but it is impossible to collect water permeating from above the soil.

In order to solve these problems, the present disclosure provides a water collecting structure. Before detailing embodiments of the present disclosure with reference to the drawings, various aspects of the present disclosure are described below.

Examples of the disclosed technique are as follows.

1st aspect: A water collecting structure for collecting water from an upstream side to a downstream side between a first soil layer and a second soil layer located below the first soil layer, the structure comprising:

a water repellent sand layer that is provided on the second soil layer, has an upper surface slanted downward from an upstream side thereof to a downstream side thereof, and is made of a plurality of particles to which water repellent treatment is applied;

a water conveying belt portion including a gravel layer and a culvert, the gravel layer being located on the upper surface of the water repellent sand layer so as to be slanted downward from an upstream-side end to a downstream-side end and being made of a plurality of gravel particles larger in diameter than the plurality of particles with the water repellent treatment of the water repellent sand layer, the culvert being located between the water repellent sand layer and the first soil layer and being provided therein with a drain hole that is slanted downward from an upstream-side end thereof to a downstream-side end thereof, the water conveying belt portion being located on the upper surface of the water repellent sand layer and below the first soil layer and allowing water flowing from the first soil layer into the gravel layer or the drain hole in the culvert to flow from an upstream-side end of the water conveying belt portion to a downstream-side end of the water conveying belt portion;

a water shield wall that is provided to surround at least the downstream-side end of the water conveying belt portion and has a through hole that the culvert penetrates; and a reservoir that stores water discharged from the drain hole in the culvert that penetrates the through hole in the water shield wall.

According to this aspect, water falling and permeating in the first soil layer is stored on the upper surface of the water repellent sand layer and flows into the water conveying belt portion on the upper surface of the water repellent sand layer. The water conveying belt portion is arranged to be slanted downward from the upstream-side end to the downstream-side end. The water having flown into the water conveying belt portion flows in the drain hole in the culvert to the downstream-side end and is discharged from the drain hole in the culvert that penetrates the water shield wall so as to be stored in the reservoir. It is thus possible to efficiently recover the water falling and permeating in the soil layer. In comparison to a case where a water shield layer is configured by a waterproof sheet or the like, the water collecting structure according to the aspect includes the water repellent sand so as to exert the effect that the structure is unlikely to be broken due to a load or vibration of a heavy machine in civil engineering or farm work, or ground change by an earthquake or the like.

2nd aspect: The water collecting structure according to the 1st aspect, wherein the water repellent sand layer is made of sand particles having an average particle diameter of 50 μm or more and 500 μm or less.

According to this aspect, sand particles of less than 50 μm in average particle diameter are difficult to be prepared and are thus unpractical. In contrast, sand particles of more than 500 μm have a water pressure resistance of 10 cm or less and thus fail to exert a sufficient water shield property as a water repellent sand layer.

3rd aspect: The water collecting structure according to the 1st or 2nd aspect, further comprising:

a vertical drain hole portion that extends vertically in the first soil layer from a surface of the first soil layer to the water conveying belt portion and is made of gravel.

According to this aspect, the vertical drain hole portion conveys surface water stored on the surface of the first soil layer to the water conveying belt portion so that the water can be discharged and recovered.

4th aspect: The water collecting structure according to the 3rd aspect, wherein the first soil layer includes a plurality of vertical drain hole portions each configured similarly to the vertical drain hole portion, and in the plurality of vertical drain hole portions, the vertical drain hole portion located on a downstream side is larger in sectional area than the vertical drain hole portion located on an upstream side.

According to this aspect, the water conveying belt portion is slanted so that the distance between the water conveying belt portion and the soil surface is longer on the downstream side rather than on the upstream side. Even when the downstream-side vertical drain hole portion of the slant is longer than the upstream-side vertical drain hole portion, the sectional area is larger and flow path resistance is smaller in this configuration. Accordingly, also the downstream-side vertical drain hole portion allows water to easily flow therethrough.

5th aspect: The water collecting structure according to the 3rd or 4th aspect, wherein in the gravel of the vertical drain hole portion, external-side gravel is smaller than center-side gravel, the external-side gravel has an average particle diameter of 1 cm or more and 5 cm or less, the center-side gravel has an average particle diameter of 2 cm or more and 10 cm or less, and the center-side gravel is larger in average particle diameter than the external-side gravel.

According to this aspect, the external-side gravel in the vertical drain hole portion is smaller and the center-side gravel is larger. This configuration prevents soil or the like of the surrounding soil layer from entering the vertical drain hole portion and filling the drain hole portion. Furthermore, the larger center-side gravel keeps larger gaps and thus allows water to smoothly flow therethrough and be easily discharged.

6th aspect: The water collecting structure according to the 1st or 2nd aspect, further comprising:

a water conveying wall that is located on an upstream side of the water shield wall and is made of dry masonry gravel so as to have a lower end in contact with the water conveying belt portion.

According to this aspect, the water conveying wall thus configured allows water collected near the water shield wall and downstream-side of the first soil layer to flow through the water conveying wall and further downward.

7th aspect: The water collecting structure according to the 3rd aspect, further comprising:

a water conveying wall that is located on an upstream side of the water shield wall and is made of dry masonry gravel so as to have a lower end in contact with the water conveying belt portion.

According to this aspect, the water conveying wall thus configured allows water collected near the water shield wall and downstream-side of the first soil layer to flow through the water conveying wall and further downward.

8th aspect: The water collecting structure according to the 6th aspect, wherein the water conveying wall has two layers including a layer made of upstream-side gravel and a layer made of downstream-side gravel, and the upstream-side gravel has an average particle diameter of 5 cm or more and 15 cm or less, the downstream-side gravel has an average particle diameter of 10 cm or more and 20 cm or less, and the downstream-side gravel is larger in average particle diameter than the upstream-side gravel.

According to this aspect, the upstream-side gravel is smaller while the downstream-side gravel is larger. This configuration prevents soil or the like of the upstream-side soil layer from entering the water conveying wall and filling the water conveying wall. Furthermore, the larger downstream-side gravel keeps large gaps and thus allows water to smoothly flow therethrough and be easily discharged.

9th aspect: The water collecting structure according to the 6th aspect, wherein the upper surface of the water repellent sand layer is configured such that a boundary surface, viewed from a downstream side thereof, with the water conveying belt portion provided between the water repellent sand layer and the first soil layer has a pair of slanted surfaces that are slanted in a V shape with respect to the water conveying belt portion.

According to this aspect, the boundary surface between the water repellent sand layer and the water conveying belt portion is slanted. In this configuration, water flows along the slanted upper surface of the water repellent sand layer toward the drain hole in the culvert of the water conveying belt portion, so as to be recovered further efficiently.

10th aspect: The water collecting structure according to the 1st aspect, wherein the gravel layer in the water conveying belt portion has at least two layers including an upper gravel layer and a lower gravel layer, the gravel in the lower gravel layer has an average diameter of 5 cm or more and 15 cm or less, the gravel in the upper gravel layer has an average diameter of 10 cm or more and 20 cm or less, and the gravel in the upper gravel layer is larger in average diameter than the gravel in the lower gravel layer.

According to this aspect, the gravel layer in the water conveying belt portion has two or more layers including the layer of the gravel close to the water repellent sand layer and the layer of the gravel located above the gravel close to the water repellent sand layer. Furthermore, the gravel close to the water repellent sand layer is smaller in average diameter whereas the gravel located above the gravel close to the water repellent sand layer is larger in average diameter. In this configuration, the sand and the gravel are in contact with each other in a larger area and the water repellent sand of the water repellent sand layer is thus hard to move. The gaps are also kept in the gravel of the gravel layer in the water conveying belt portion and water thus flows easily.

The embodiment of the present invention is described below with reference to the drawings.

EMBODIMENT

Figure 1B:
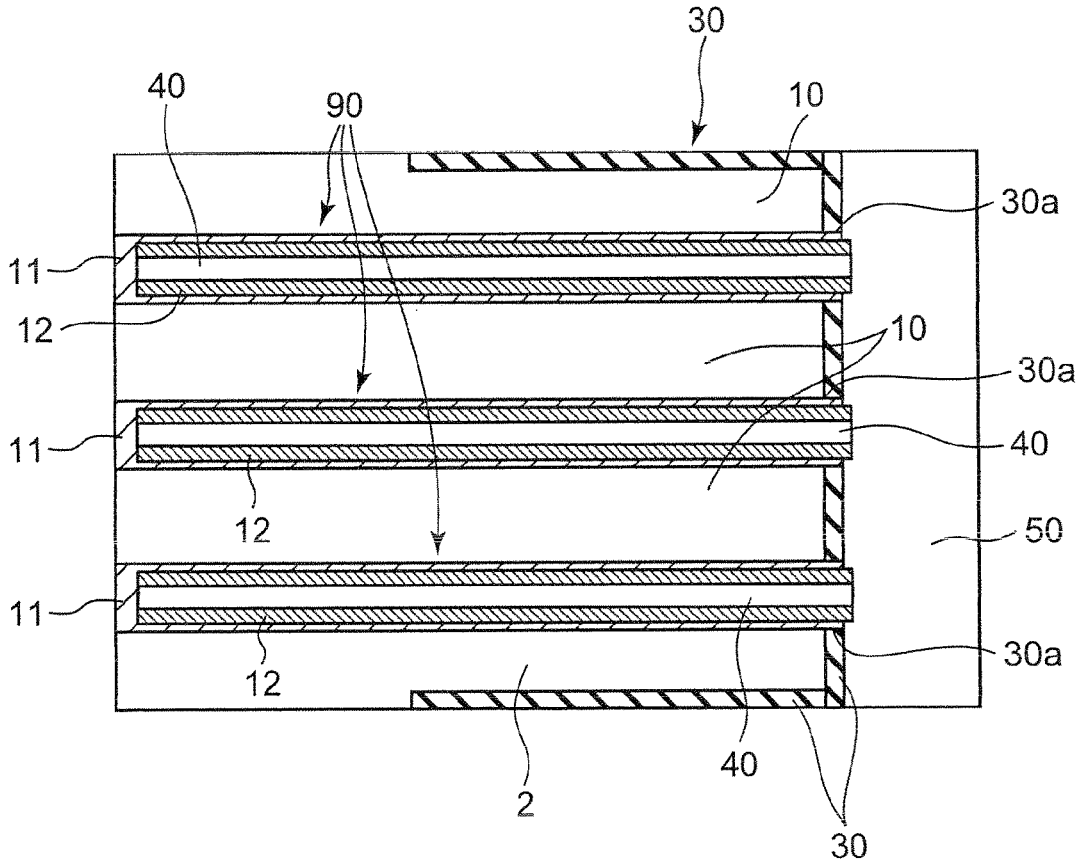
FIG. 1B is a transverse sectional view taken along line A-A indicated in FIG. 1A, as a plan view showing a state where a plurality of water collecting structures are located and a first soil layer is removed.
Figure 1C:
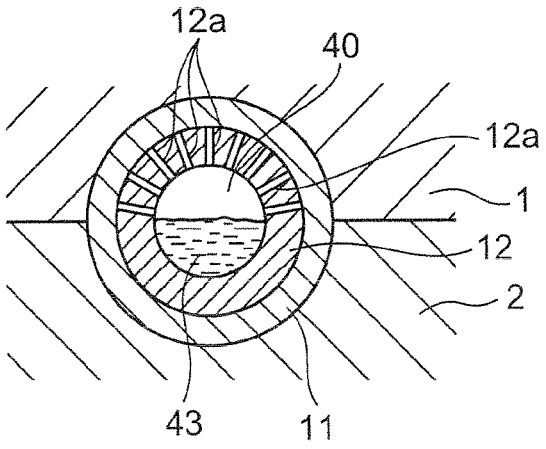
FIG. 1C is an enlarged vertical sectional view of the culvert in the water collecting structure shown in FIG. 1A.

FIG. 1A is a vertical section side view of a water collecting structure 90. FIG. 1B is a transverse sectional view taken along line A-A indicated in FIG. 1A, as a plan view showing a state where a plurality of (according to an example, three in FIG. 1B) water collecting structures 90 are located and a first soil layer is removed. According to an example, the water collecting structures 90 are located in parallel with each other at equal intervals. FIG. 1C is an enlarged vertical sectional view of a culvert 12 in the water collecting structure 90 shown in FIG. 1A.

Each of the water collecting structures 90 shown in FIGS. 1A and 1B includes at least a water repellent sand layer 10, a water conveying belt portion 20, a water shield wall 30, and a drain cylindrical portion (a drain pipe or a drain hole) 40. The water collecting structure 90 collects rainwater or water that is artificially supplied to the soil layer. The water collecting structure 90 is located inside the soil layer and below a soil layer that is supplied with water.

In the present Description, the soil layer located below the water collecting structure 90 is referred to as a "second soil layer" 2 and the soil layer supplied with water and located above the water collecting structure 90 is referred to as the "first soil layer" 1. The water collecting structure 90 is accordingly located (at the boundary) between the upper first soil layer 1 and the lower second soil layer 2.

<Water Repellent Sand Layer 10>

Each of the water collecting structures 90 shown in FIGS. 1A and 1B collects water that is supplied to the first soil layer 1 and is discharged from the first soil layer 1. The water repellent sand layer 10, which serves as a water shield layer and is made of water repellent sand, is located between the first soil layer 1 and the second soil layer 2 and is located such that one end is downward slanted toward the other end. In this configuration, water supplied to the first soil layer 1 is discharged outward. The water repellent sand layer 10 is slanted downward, so that water moves downward along the water repellent sand layer 10 due to gravity and is discharged outward from the water repellent sand layer 10. The expression "slant" herein means inclining towards the gravity direction.

Of the slanted water repellent sand layer 10, the upper end is referred to as a "first end" 10*a* and the lower end is referred to as a "second end" 10*b*. More specifically, the water repellent sand layer 10 is located on an upper surface 2*a* of the second soil layer 2 so as to be slanted downward from the first end 10*a* to the second end 10*b*. In other words, according to an example, the water repellent sand layer 10 is provided so as to have constant thickness in the vertical direction so that an upper surface 10*c* and a lower surface 10*d* of the water repellent sand layer 10 are slanted downward from the first end 10*a* to the second end 10*b*, similarly to the upper surface 2*a* of the second soil layer 2. It is important that the upper surface 10*c* of the water repellent sand layer 10 is securely slanted downward from the first end 10*a* to the second end 10*b*. In contrast, none of the lower surface 10*d* of the water repellent sand layer 10 and the upper surface 2*a* of the second soil layer 2 is necessarily slanted downward from the first end 10*a* to the second end 10*b*. In a case where the water repellent sand layer 10 can be varied in thickness, the lower surface 10*d* of the water repellent sand layer 10 and the upper surface 2*a* of the second soil layer 2 are not necessarily slanted similarly to the upper surface 10*c* of the water repellent sand layer 10.

According to an example, the water repellent sand layer 10 is 1 cm or more and 10 cm or less in thickness and is slanted by 1/1000 or more and 3/100 or less.

The "water repellent sand" includes a plurality of particles having surfaces to which water repellent treatment is applied. The particles include sand, silt, and clay. The sand includes particles having diameters of more than 0.075 mm and 2 mm or less. The silt includes particles having diameters of more than 0.005 mm and 0.075 mm or less. The clay includes particles having diameters of 0.005 mm or less.

Examples of the particles having the surfaces to which water repellent treatment is applied include particles having surfaces to which water repellent treatment is applied using a chlorosilane-based material, an alkoxysilane-based material, or the like.

Examples of the chlorosilane-based material include heptadecafluoro-1,1,2,2-tetrahydrodecyl trichlorosilane and n-octadecyldimethylchlorosilane. Examples of the alkoxysilane-based material include n-octadecyltrimethoxysilane and nonafluorohexyltriethoxysilane.

Examples of a material for the water repellent treated particles include soil and glass beads. The soil includes an inorganic substance, a colloidal inorganic substance, a coarse organic substance, or an organic substance obtained by alteration such as microbial decomposition.

<Water Conveying Belt Portion 20>

The water conveying belt portion 20 includes at least one or both of a gravel layer 11 and the culvert 12 that are provided between the water repellent sand layer 10 and the first soil layer 1 above the water repellent sand layer 10. The water conveying belt portion 20 is slanted. The water conveying belt portion 20 is slanted downward in the direction similar to the slant of the water repellent sand layer 10. According to an example, the water conveying belt portion 20 is provided so as to have constant thickness and is slanted such that the longitudinal side of the water conveying belt portion 20 is parallel to the upper surface of the water repellent sand layer 10.

In the water conveying belt portion 20, a portion located above the first end 10*a* of the water repellent sand layer 10 is referred to as a "third end" 20*a* and a portion located above the second end 10*b* of the water repellent sand layer 10 is referred to as a "fourth end" 20*b*.

The gravel layer 11 is formed by a plurality of gravel particles having diameters of more than 2 mm and 75 mm or less. The plurality of gravel particles have diameters (e.g. average diameter) larger than the diameters of the plurality of water repellent treated particles of the water repellent sand layer 10.

The culvert 12 is configured by a cylindrical body (pipe), such as a concrete pipe, which surrounds the drain hole 40 penetrating axially or the like. As shown in FIG. 1C, the culvert 12 is provided, in the upper half of a pipe peripheral wall, with a large number of through holes 12*a*, whereas there is formed no through hole 12*a* in the lower half of the pipe peripheral wall. In this configuration, water 43 entering the drain hole 40 in the culvert 12 through the large number of through holes 12*a* is collected in the drain hole 40 and flows downward along the drain hole 40, in other words, flows toward a reservoir 50, so as to be recovered in the reservoir 50.

According to an example, the gravel layer 11 in the water conveying belt portion 20 is 1 cm or more and 5 cm or less in thickness, and the culvert 12 is 5 cm or more and 20 cm or less in thickness. According to an example, these portions are slanted by 1/1000 or more and 3/100 or less.

FIG. 1A exemplifies the configuration in which the gravel layer 11 of constant thickness is located above, below, and on the left and right sides of the culvert 12. The present disclosure is not limited to this configuration. For example, the gravel layer 11 may not be located below the culvert 12. In order to recover water flowing in the gravel layer 11 below the culvert 12 into the drain hole 40 in the culvert 12, the culvert 12 can be provided, on the bottom and the sides near the water shield wall 30, with through holes 12*a*.

<Water Shield Wall 30 and Reservoir 50>

The water shield wall 30 is provided to prevent water from being discharged from any portion other than the water conveying belt portion 20 while water collected at the water conveying belt portion 20 is discharged into the reservoir 50. More specifically, the water shield wall 30 is provided at the downstream side (the end edge of the fourth end 20*b*) of the slanted water conveying belt portion 20 so as to be in contact with the gravel layer 11 at the fourth end 20*b* and the peripheral first soil layer 1. The water shield wall 30 is provided with a through hole 30*a* that the culvert 12 at the fourth end 20*b* of the water conveying belt portion 20 penetrates, so that the culvert 12 at the fourth end 20*b* penetrates the through hole 30*a* and projects toward the reservoir 50. The culvert 12 penetrates the water shield wall 30 and projects toward the reservoir 50 in this manner, so that water collected in the drain hole 40 can be reliably discharged into the reservoir 50. The water shield wall 30 can be made of any material as long as the material has a water shield property. Water flowing in portions other than the culvert 12 at the fourth end 20*b* of the water conveying belt portion 20 coupled to the through hole 30*a* in the water shield wall 30, such as water flowing in the gravel layer 11 at the fourth end 20*b* of the water conveying belt portion 20 and water flowing in the first soil layer 1 adjacent to the water shield wall 30, cannot pass through the water shield wall 30 but is once stored inside the water shield wall 30 (opposite to the reservoir 50), passes through the through holes 12*a* in the culvert 12, is recovered in the drain hole 40, then passes through the through hole 30*a* in the water shield wall 30, and is recovered in the reservoir 50.

FIG. 1B exemplifies the configures in which, at the end of the first soil layer 1 close to the reservoir 50, the periphery of the fourth end 20*b*, which is in contact with the culvert 12, of the water conveying belt portion 20 of each of the three water collecting structures 90 is covered with the water shield wall 30 as well as the gravel layer 11 and the first soil layer 1 located therearound. Furthermore, the both lateral portions of the first soil layer 1, from the fourth end 20*b* side of the water conveying belt portion 20 to around the longitudinal center of the water collecting structure 90 on the both ends or further, are covered with the water shield wall 30 such that the lateral portions of the outer water collecting structures 90 out of the three water collecting structures 90 are surrounded by the water shield wall 30 with constant gaps being provided from the outer water collecting structures 90 on the both ends. In FIG. 1B, the water shield wall 30 has a C shape surrounding the first soil layer 1 in a planar view.

According to an example, the water shield wall 30 has a side surface at least longer than the surface at the downstream side.

In this configuration, water flowing downward in the first soil layer 1 or on the water repellent sand layer 10 other than the water conveying belt portion 20 and water flowing in the gravel layer 11 of the slanted water conveying belt portion 20 can be once collected at the water shield wall 30 and be then collected in the drain hole 40 through the culvert 12. Water flowing in the drain hole 40 and water once collected at the water shield wall 30 and then collected in the drain hole 40 through the culvert 12 are discharged to the reservoir 50 through the drain hole 40 in the culvert 12 that penetrates the water shield wall 30, and are then collected in the reservoir 50. FIGS. 1A and 1B show the state where the drain hole 40 is configured by the culvert 12 and an end of the culvert 12 is coupled to the through hole in the water shield wall 30 so that water collected in the drain hole 40 in the culvert 12 is discharged into the reservoir 50. The water shield wall 30 is provided on the entire plane from the periphery of the lower end of the water collecting structure 90 including the gravel layer 11 at the fourth end 20*b* of the water conveying belt portion 20 to the first soil layer 1 therearound, so that water is not discharged outward from any portion other than the drain hole 40 in the culvert 12. This configuration is practical and excellent in water collection efficiency. This provision on the entire plane means that water is not discharged outward from any portion other than the drain hole 40. The wall does not necessarily cover the entire end surface of the first soil layer 1 and the like.

According to an example, the reservoir 50 is located below the lower end of the culvert 12 so as to collect water discharged from the drain hole 40. Instead of providing the reservoir 50, water discharged from the drain hole 40 at the lower end of the culvert 12 can be directly supplied to a necessary portion, such as the first soil layer 1 or any other soil layer that uses the collected water. A constituent element for collecting water, such as the reservoir 50, can be also called a water storage.

Figure 2:
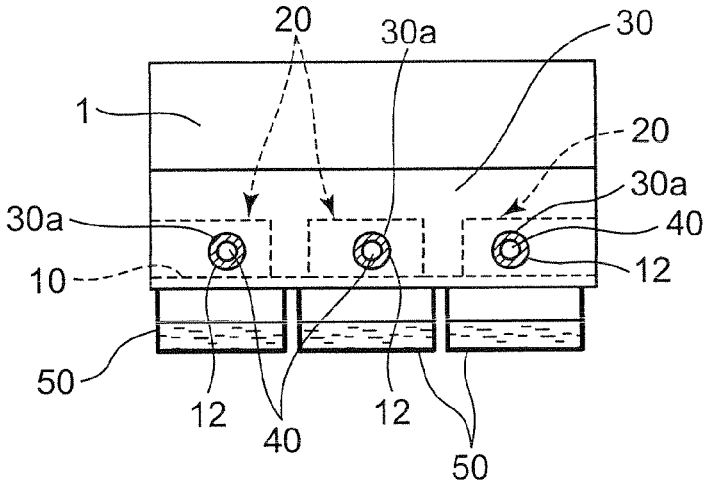
FIG. 2 is a view of the water collecting structure when seen from the downstream side.

As shown in FIG. 1B, the number of the water conveying belt portion 20 is not limited to one but a plurality of water conveying belt portions can be located at intervals. As shown in FIG. 2, the water shield wall 30 can be provided with a plurality of drain holes 40 (three in FIG. 2) so as to be connected to downstream sides of the plurality of water conveying belt portions 20 (see dotted lines). Furthermore, the reservoir 50 has only to store water discharged from the drain holes 40, and there can be provided one or a plurality of reservoirs. More specifically, FIG. 2 shows the state where one reservoir 50 is provided for each drain hole 40, although one reservoir 50 can be provided for a plurality of drain holes 40.

According to an example, a practical average diameter of sand particles of the water repellent sand is 50 μm or more and 500 μm or less. The surfaces of the sand particles are coated with a water repellent material to obtain water repellent sand having excellent water repellency. Furthermore, according to an example, the sand particles are prepared using Toyoura sand so as to provide water repellent sand in which surfaces of Toyoura sand particles are coated with organic molecules. The water repellent sand layer made of such water repellent sand exerts the excellent property as a water shield layer, and the water collecting structure 90 can be thus configured.

Figure 3:
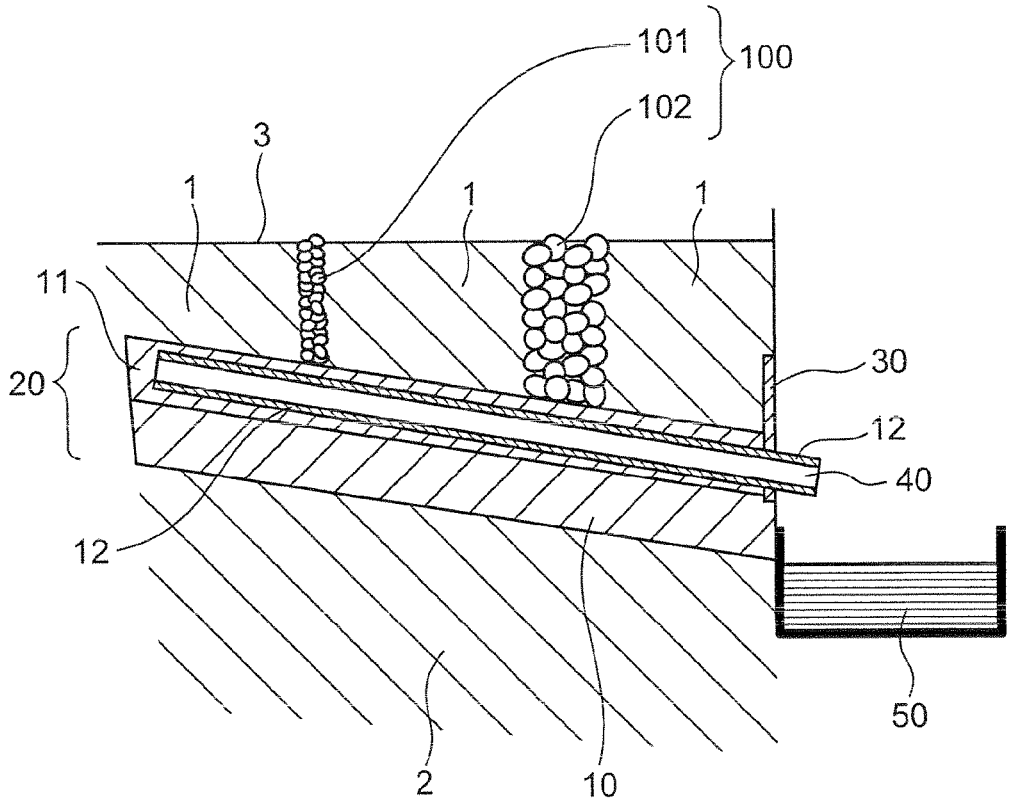
FIG. 3 is a view of a water collecting structure that includes a vertical drain hole portion made of gravel so as to discharge surface water stored on a surface of the soil layer.

According to a modification example of the embodiment, as shown in FIG. 3, in order to discharge surface water stored on a surface 3 of the first soil layer 1, one or a plurality of vertical drain hole portions 100 vertically penetrating the first soil layer 1 and made of gravel are provided between the water conveying belt portion 20 and the surface 3 of the first soil layer 1. The drain hole portion 100 itself is a layer (portion) that has a bar shape such as a columnar shape and has water repellency. The layer having the water repellency is exemplified by a layer made of a plurality of hydrophobic particles such as gravel. There can be provided a plurality of vertical drain hole portions 100 (101 and 102).

As shown in FIG. 3, the downstream-side vertical drain hole portion 102 can be made larger in sectional area perpendicular to the vertical direction of the vertical drain hole portion (the vertical drain hole portion 102 can be made larger in diameter) than the upstream-side vertical drain hole portion 101 of the slant. In this configuration, the water conveying belt portion 20 is slanted so that the distance between the water conveying belt portion 20 and the soil surface 3 is longer at the downstream side rather than at the upstream side. Even when the downstream-side vertical drain hole portion 102 of the slant is longer than the upstream-side vertical drain hole portion 101, the sectional area is larger and flow path resistance is smaller in this configuration. Accordingly, also the downstream-side vertical drain hole portion 102 allows water to easily flow therethrough.

According to an example, the vertical drain hole portion 100 has a diameter of 5 cm or more and 10 cm or less.

Figure 4:
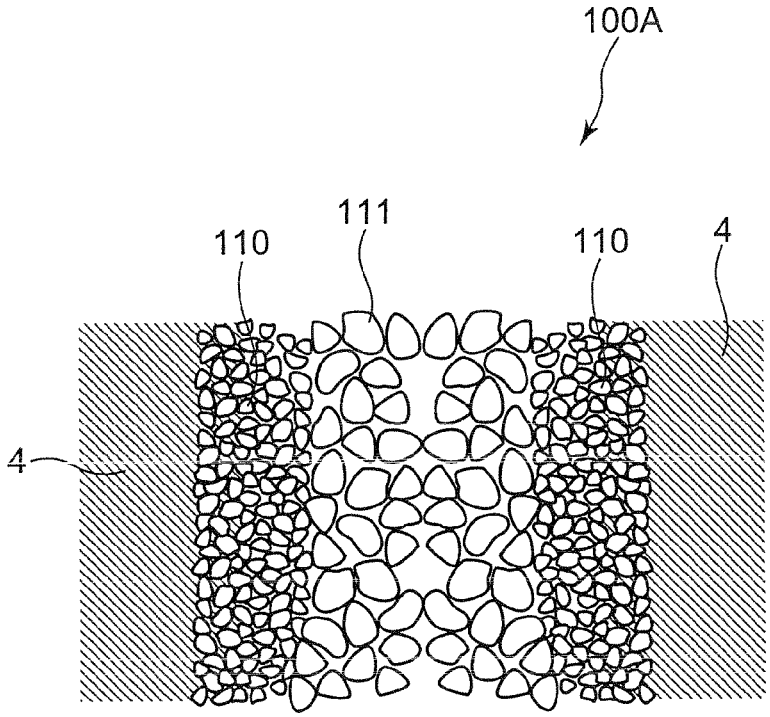
FIG. 4 is an enlarged view of the vertical drain hole portion made of gravel.

According to another modification example of the embodiment, the drain hole portion 100 can be made of two types of gravel particles. More specifically, FIG. 4 shows an enlarged vertical sectional view of each vertical drain hole portion 100A that is made of smaller external-side gravel 110 and larger center-side gravel 111. This configuration can prevent soil or the like of a peripheral soil layer 4 from entering the vertical drain hole portion 100A and filling the vertical drain hole portion 100A. Furthermore, the larger center-side gravel 111 keeps large gaps and thus allows water to smoothly flow therethrough and be easily discharged. According to an example, the external-side gravel 110 has an average particle diameter of 1 cm or more and 5 cm or less, the center-side gravel 111 has an average particle diameter of 2 cm or more and 10 cm or less, and the average particle diameter of the center-side gravel 111 is larger than the average particle diameter of the external-side gravel 110. According to an example, the ratio in radius of the region of the center-side gravel 111 to the region of the external-side gravel 110 is 4.5:0.5.

Figure 5:
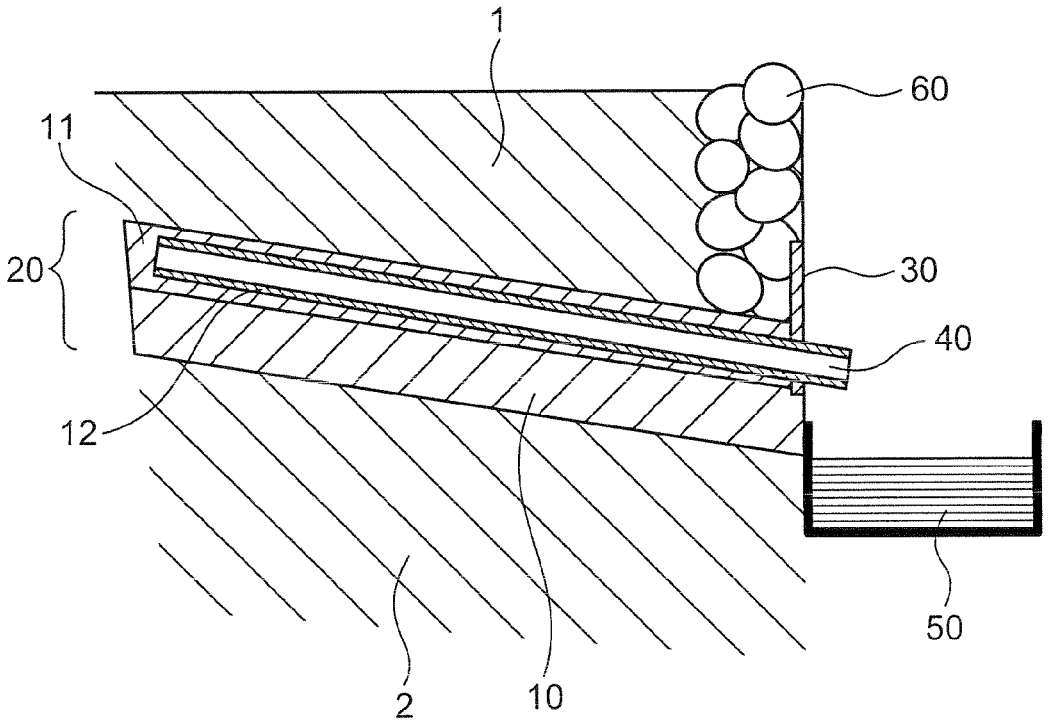
FIG. 5 is a view of a water collecting structure including a water conveying wall that is made of dry masonry gravel and is located on an upstream side of the water shield wall, so as to allow water to fall downward.

According to still another modification example of the embodiment, as shown in FIG. 5, a water conveying wall 60 made of dry masonry gravel is provided from above the water conveying belt portion 20 to the surface of the first soil layer 1 and near the upstream side of the water shield wall 30 and along a virtual plane parallel to the upstream-side surface of the water shield wall 30. The water conveying wall 60 has a lower end in contact with the water conveying belt portion 20 (e.g. the gravel layer 11). The water conveying wall 60 thus configured allows water collected near the water shield wall 30 and at the downstream side of the first soil layer 1 to flow through the water conveying wall 60 and further downward. Water flowing downward through the water conveying wall 60 to the water conveying belt portion 20 that is located between the water repellent sand layer 10 and the first soil layer 1 thereabove enters the drain hole 40 through the through holes 12*a* in the culvert 12 of the water conveying belt portion 20, flows in the drain hole 40 to the slanted downstream side, and is recovered in the reservoir 50. This configuration enables efficient recovery of water.

Furthermore, the water conveying wall 60 is made of dry masonry gravel of 5 cm to 20 cm in size. This configuration keeps sufficient gaps in the gravel and thus allows water to easily flow downward, so as to enable efficient recovery of water.

Figure 6:
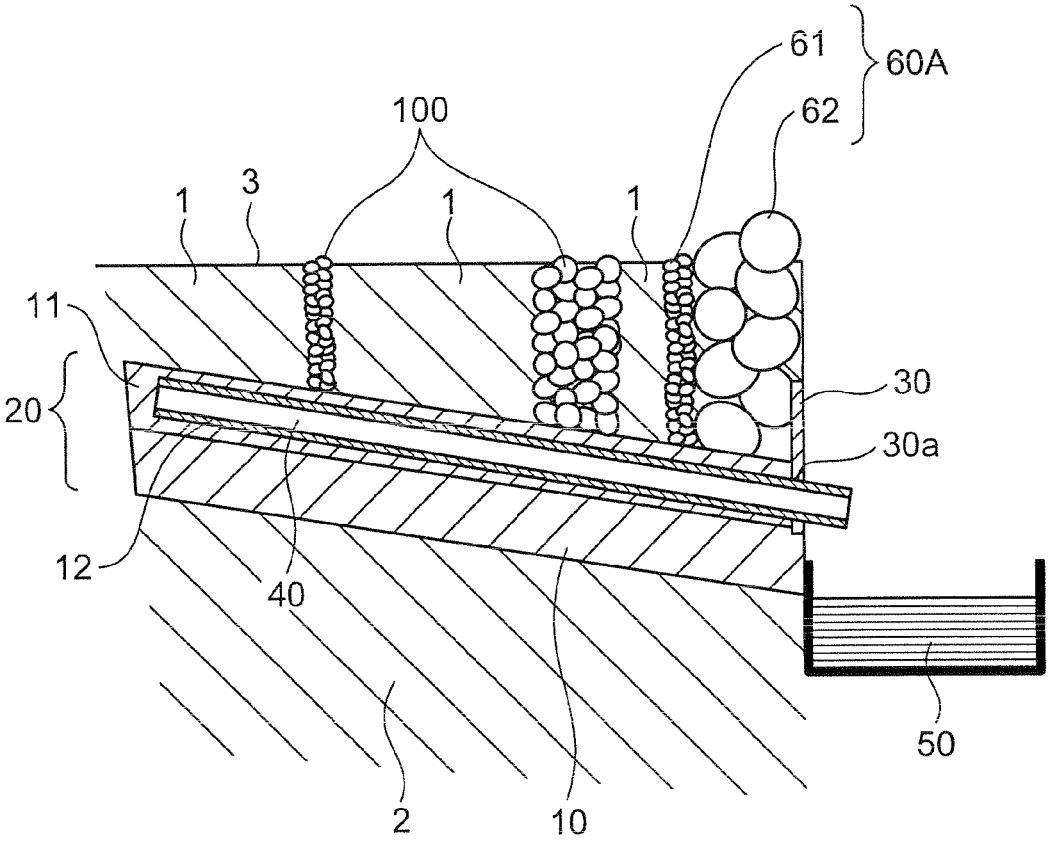
FIG. 6 is a water collecting structure in which the upstream-side gravel of the water conveying wall is smaller in size and the downstream-side gravel is larger in size.

According to a further different modification example of the embodiment, a water conveying wall 60A can have two layers including a layer made of upstream-side gravel 61 and a layer made of downstream-side gravel 62. More specifically, as shown in FIG. 6, the upstream-side gravel 61 is smaller while the downstream-side gravel 62 is larger in the water conveying wall 60A. This configuration can prevent soil or the like of the upstream-side soil layer 1 from entering the water conveying wall 60 and filling the water conveying wall 60. Furthermore, the larger downstream-side gravel 62 keeps large gaps and thus allows water to smoothly flow therethrough and be easily discharged. According to an example, the upstream-side gravel 61 has an average particle diameter of 5 cm or more and 15 cm or less, the downstream-side gravel 62 has an average particle diameter of 10 cm or more and 20 cm or less, and the average particle diameter of the downstream-side gravel is larger than the average particle diameter of the upstream-side gravel 61.

Figure 7:
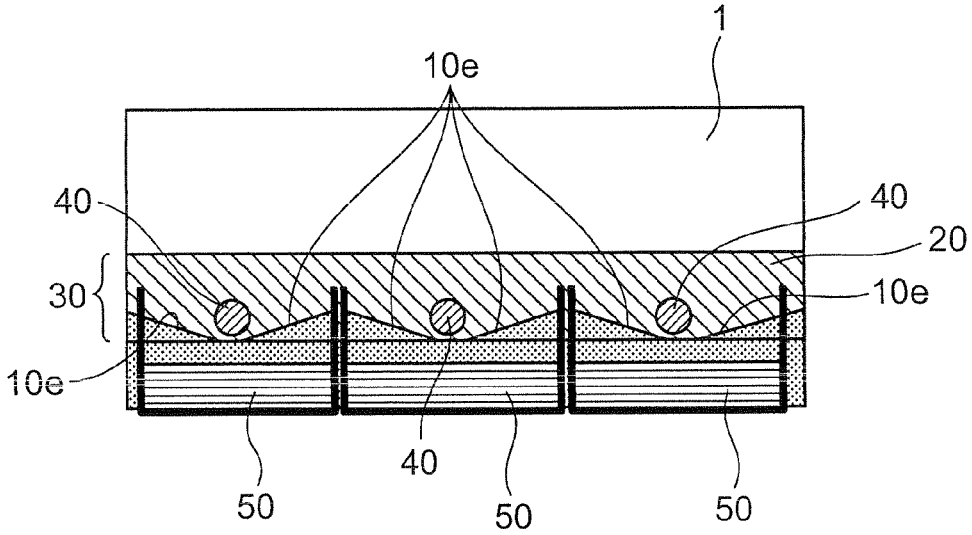
FIG. 7 is a view of the water conveying belt portion seen from the downstream side, in which reservoirs are located correspondingly to drain holes and a boundary surface between the water repellent sand layer and the water conveying belt portion located between the water repellent sand layer and the upper soil layer is slanted so that water is collected in the reservoirs.

According to a further different modification example of the embodiment, the upper surface 10*c* of the water repellent sand layer 10 is not planar but can be configured by two slanted surfaces 10*e* that are bent into a V shape in vertical cross section with respect to the water conveying belt portion 20. More specifically, as shown in FIG. 7 viewed from the downstream side in a state where the water shield wall 30 is removed, the reservoirs 50 can be located correspondingly to the drain holes 40 in the water conveying belt portions 20 so as to collect water. In this configuration, the boundary surface 10*e* between the water repellent sand layer 10 and the water conveying belt portion 20 is slanted. Water thus flows along the slanted upper surface of the water repellent sand layer 10 toward the drain hole 40 in the culvert 12 of the water conveying belt portion 20, so as to be recovered further effectively. As shown in FIGS. 1A and 1B, the water repellent sand of the water repellent sand layer 10 enters the gravel layer 11 of the water conveying belt portion from the boundary between the water repellent sand layer 10 and the water conveying belt portion 20. In this configuration, the sand and the gravel are in contact with each other in a larger area and the water repellent sand of the water repellent sand layer 10 is thus hard to move.

Figure 8:
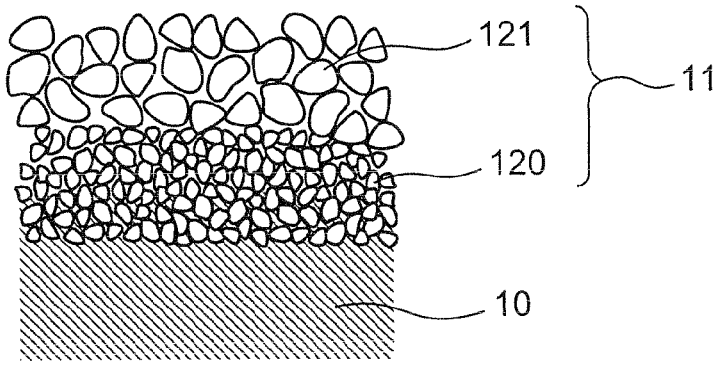
FIG. 8 is an enlarged view of the water conveying belt portion located between the water repellent sand layer and the upper soil layer.

As in FIG. 8 showing an enlarged view of the water repellent sand layer 10 and the gravel layer 11, the gravel layer 11 of the water conveying belt portion 20 can have at least two layers. More specifically, the gravel layer 11 has two layers including a layer of gravel 120 close to the water repellent sand layer 10 and a layer of gravel 121 above the gravel 120. Furthermore, the gravel 120 close to the water repellent sand layer 10 is smaller in average diameter while the upper gravel 121 is larger in average diameter. In this configuration, the sand and the gravel are in contact with each other in a larger area and the water repellent sand of the water repellent sand layer 10 is thus hard to move. The gaps are also kept in the gravel of the gravel layer 11 of the water conveying belt portion 20 and water thus flows easily. According to an example, the gravel 120 close to the water repellent sand layer has an average particle diameter of 5 cm or more and 15 cm or less, the upper gravel 121 has an average particle diameter of 10 cm or more and 20 cm or less, and the average particle diameter of the upper gravel 121 is larger than the average particle diameter of the gravel 120 close to the water repellent sand layer.

According to the embodiment described above, water falling and permeating from the ground surface into the first soil layer 1 is stored on the upper surface 10*c* of the water repellent sand layer 10 and flows into the water conveying belt portion 20 on the upper surface 10*c* of the water repellent sand layer 10. The water conveying belt portion 20 is located to be slanted downward from the upstream-side end 20*a* to the downstream-side end 20*b*. Water flowing into the water conveying belt portion 20 flows downward in the drain hole 40 in the culvert 12 and is discharged from the drain hole 40 in the culvert 12 that penetrates the water shield wall 30 so as to be stored in the reservoir 50.

More specifically, water falling and permeating from the ground surface 3 into the first soil layer 1 is blocked by the water repellent sand layer 10 that is made of water repellent sand and is located underground so as to have the slanted upper surface 10*c*, and is prevented from flowing downward from the water repellent sand layer 10. The water blocked by the water repellent sand layer 10 thus flows in the water conveying belt portion 20 on the upper surface 10*c* of the water repellent sand layer 10 and flows downward to the downstream side of the water conveying belt portion 20. The water shield wall 30 located at the downstream side of the water conveying belt portion 20 blocks water flowing downward through the water conveying belt portion 20 and the water repellent sand layer 10 excluding the culvert 12. Accordingly, only the water collected by the culvert 12 can be recovered in the reservoir 50 through the through hole 30*a* in the water shield wall 30.

It is thus possible to efficiently recover the water falling and permeating in the soil layer 1.

In comparison to a waterproof sheet or the like used as a water shield layer in a water recovery system including a slanted structure according to a conventional technique, when such a water shield layer is configured by the water repellent sand layer 10 made of water repellent sand, the water repellent sand layer 10 is less likely to be broken due to a load or vibration of a heavy machine in civil engineering or farm work, or ground change by an earthquake or the like, and can be self-repaired. More specifically, even in a case where the water repellent sand layer 10 is partially broken to form a hole, the water repellent sand around the formed hole flows into the hole to fill the hole, so that the water repellent sand layer 10 can be self-repaired. Furthermore, in a case where a ground water level rises, the water repellent sand layer 10 is capable of blocking capillary rise of water from below the water repellent sand layer 10 and thus preventing salt damage. When the water conveying belt portion 20 includes the gravel layer 11, the difference in particle diameter between the soil of the first soil layer 1 above the water conveying belt portion 20 and the particles of the gravel layer 11 causes the capillary barrier effect. When the water collecting structure is utilized as farmland, water can be appropriately kept in a plow layer. Furthermore, the water repellent sand layer 10 prevents water containing a fertilizer component such as nitrate nitrogen from falling and permeating into ground water, so that the effect of preventing ground water pollution can be expected. Moreover, if recovered water, which contains the fertilizer component, is utilized as irrigation water, the fertilizer can be utilized efficiently.

The present invention is described in more detail below with reference to working examples and a comparative working example.

Working Example 1

Laboratory Experiment on Water Collecting Structure Including Water Repellent Sand Layer Toyoura sand was used for sand particles, and water repellent sand was prepared by water repellent treatment using (heptadecafluoro-1,1,2,2,-tetrahydrodecyl)trichlorosilane and $CF_3(CF_2)_7(CH_2)_2SiCl_3$). An acrylic water tank having a holed bottom is filled with pebbles, decomposed granite soil (corresponding to the second soil layer), the water repellent sand (corresponding to the water repellent sand layer), and culture soil (corresponding to the first soil layer) from the bottom in this order so as to be layered. The water repellent sand layer was spread so as to be slanted, and the acrylic water tank was provided, at a downstream-side end, with a drain hole. Water was then sprinkled evenly from above the acrylic water tank and how the water falls and permeates underground was observed. In this case, any water conveying belt portion 20 was not particularly provided.

At the end of the experiment, it was found that water was discharged through the drain hole into a water tank that is provided laterally to the acrylic water tank having the water repellent sand layer. Furthermore, no water was stored in a container that is located below the acrylic water tank and the water repellent sand layer or the decomposed granite soil therebelow was not changed in color. It was thus found that the water repellent sand layer blocked water from falling and permeating.

Comparative Working Example 1

An experiment was carried out similarly to the working example 1 except that the water repellent sand was replaced with Toyoura sand with no water repellent treatment to configure an ordinary sand layer. At the end of the experiment, in the water tank having the ordinary sand layer, permeating water was not blocked by the ordinary sand layer but fell and permeated, so that the ordinary sand layer and the decomposed granite soil were changed in color. It was also found that water was stored in the container located below the acrylic water tank and no water was discharged through the drain hole into the container lateral to the acrylic water tank.

Working Example 2

The water tank having the water repellent sand layer as used in the working example 1 was vibrated on a table. There was found no change in outer appearance of the water repellent sand layer. Similarly to the working example 1, water was then sprinkled evenly from above and how the water falls and permeates underground was observed. The result was similar to that prior to the vibration, more specifically, any change by the vibration was not observed and the layer was not broken.

Working Example 3

Water Collecting Structure Provided Outdoors on Actual Scale

In order to test facility of constructing water repellent sand and durability of the water collecting structure, a region of 5 m×5 m was divided at the center into two sections by an impermeable plate. An experimental field having a water repellent sand layer in one of the sections and an ordinary sand layer in the other section was formed in the outdoor natural environment. Each of the water repellent sand layer and the ordinary sand layer had an upper surface slanted by 1/100, and provided thereabove in each of the sections were four pipes exemplifying culverts in water conveying belt portions and a pebble layer exemplifying the gravel layer. A tank exemplifying the reservoir 50 was located to recover water that is conveyed to the lower end of the drain hole 40 in the culvert pipe.

In order to discharge water stored on the soil surface, a vertical drain hole portion was provided by forming a hole in the soil layer and filling the hole with gravel so that the vertical drain hole portion connects from the soil surface to the culvert pipe and the pebble layer. Water was likely to be stored in the soil surrounded with the water repellent sand layer and the water conveying belt portion. A water conveying wall made of dry masonry gravel was provided upstream side of the water shield wall so that the water in this soil flowed downward and was easily collected from the drain hole.

In this configuration, water collection conditions were compared to find that water collected in the tank having the water repellent sand layer was larger in volume than water collected in the tank having the ordinary sand layer.

Working Example 4

Experiment on Blocking Capillary Rise of Seawater Using Water Repellent Sand Layer Acrylic cylinders having 34.5 cm in inner diameter and 100 cm in height were filled with ordinary sand and water repellent sand that were air-dried. A column 1 was filled only with ordinary sand, whereas each of columns 2 and 3 had a water repellent sand layer in a region of 25 cm to 35 cm from the bottom. The column 3 was further provided with a drain hole so that falling and permeating water was discharged. Sensors (5TE manufactured by Decagon Devices, Inc.) for measuring a volume water content, temperature, and electric conductivity were located at the heights of 10 cm, 30 cm, 50 cm, 70 cm, and 90 cm, from the bottom, and measurement was carried out every ten minutes. The acrylic cylinders were located outdoors. After the start of measurement with the sensors, the acrylic cylinders were kept in a state where seawater was stored to the height of 10 cm so that capillary rise of seawater was caused from the bottom of the apparatuses.

For two months from the start of the experiment, the electric conductivity in each of the columns rose immediately after the start of the experiment at the height of 10 cm. It was thus found out seawater permeated to this height. The column 1 filled only with ordinary sand allowed seawater to permeate due to capillary rise to the height of 30 cm, whereas the columns 2 and 3 each having the water repellent sand layer (25 cm to 30 cm) blocked capillary rise of seawater.

In comparison to a case where a water shield layer is configured by a waterproof sheet or the like, the water collecting structure 90 according to the embodiment includes the water repellent sand so as to exert the effect that the structure is unlikely to be broken due to a load or vibration of a heavy machine in civil engineering or farm work, or ground change by an earthquake or the like.

Though the present invention has been described above based on the above embodiments, the present invention should not be limited to the above-described embodiments.

By properly combining the arbitrary embodiment(s) or modification(s) of the aforementioned various embodiments and modifications, the effects possessed by the embodiments can be produced.

INDUSTRIAL APPLICABILITY

The water collecting structure according to the present invention is configured using the technique that enables efficient recovery of falling and permeating water as well as enables blocking of a pollutant in falling and permeating groundwater. The former property of this technique enables utilization not only as agricultural water but also as daily life water, and enhances possibility of effective utilization of rainwater by water collecting structures of a small self-distribution type. The latter property of this technique prevents pollution of ground water when the water collecting structure is located underground at a plant, a waste disposal site, or the like.

The entire disclosure of Japanese Patent Application No. 2012-210805 filed on Sep. 25, 2012, including specification, claims, drawings, and summary are incorporated herein by reference in its entirety.

Although the present invention has been fully described in connection with the embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

The invention claimed is:

1. A water collecting structure for collecting water from an upstream side to a downstream side between a first soil layer and a second soil layer located below the first soil layer, the structure comprising:

a water repellent sand layer that is provided on the second soil layer, the water repellant sand layer having an upper surface slanted downward from an upstream side of the water repellent sand layer to a downstream side of the water repellent sand layer, and is made of a plurality of particles to which water repellent treatment is applied;

a water conveying belt portion including a gravel layer and a culvert, the gravel layer being located on the upper surface of the water repellent sand layer so as to be slanted downward from an upstream-side end to a downstream-side end and being made of a plurality of gravel particles larger in diameter than the plurality of particles with the water repellent treatment of the water repellent sand layer, the culvert being located between the water repellent sand layer and the first soil layer and having a drain hole that is slanted downward from an upstream-side end of the culvert to a downstream-side end of the culvert, the water conveying belt portion being located on the upper surface of the water repellent sand layer and below the first soil layer and allowing water flowing from the first soil layer into the gravel layer or the drain hole in the culvert to flow from an upstream-side end of the water conveying belt portion to a downstream-side end of the water conveying belt portion;

a water shield wall that is provided to surround at least the downstream-side end of the water conveying belt portion and has a through hole that the culvert penetrates;

a reservoir that stores water discharged from the drain hole in the culvert that penetrates the through hole in the water shield wall; and a water conveying wall that is located on an upstream side of the water shield wall and is made of dry masonry gravel so as to have a lower end in contact with the water conveying belt portion.

2. The water collecting structure according to claim 1, wherein the water repellent sand layer is made of sand particles having an average particle diameter of 50 μm or more and 500 μm or less.

3. The water collecting structure according to claim 2, further comprising:

at least one vertical drain hole portion that extends vertically in the first soil layer from a surface of the first soil layer to the water conveying belt portion and is made of gravel.

4. The water collecting structure according to claim 2, further comprising:

a water conveying wall that is located on an upstream side of the water shield wall and is made of dry masonry gravel so as to have a lower end in contact with the water conveying belt portion.

5. The water collecting structure according to claim 1, further comprising:

at least one vertical drain hole portion that extends vertically in the first soil layer from a surface of the first soil layer to the water conveying belt portion and is made of gravel.

6. The water collecting structure according to claim 5, wherein the first soil layer includes a plurality of vertical drain hole portions each configured similarly to the vertical drain hole portion, and in the plurality of vertical drain hole portions, the vertical drain hole portion located on a downstream side is larger in sectional area than the vertical drain hole portion located on an upstream side.

7. The water collecting structure according to claim 5, wherein in the gravel of the vertical drain hole portion having an external-side and a center-side, the external-side gravel has an average particle diameter of 1 cm or more and 5 cm or less, the center-side gravel has an average particle diameter of 2 cm or more and 10 cm or less, and the center-side gravel is larger in average particle diameter than the external-side gravel.

8. The water collecting structure according to claim 5, further comprising:

a water conveying wall that is located on an upstream side of the water shield wall and is made of dry masonry gravel so as to have a lower end in contact with the water conveying belt portion.

9. The water collecting structure according to claim 3, wherein the first soil layer includes a plurality of vertical drain hole portions each configured similarly to the vertical drain hole portion, and in the plurality of vertical drain hole portions, the vertical drain hole portion located on a downstream side is larger in sectional area than the vertical drain hole portion located on an upstream side.

10. The water collecting structure according to claim 3, wherein in the gravel of the vertical drain hole portion having an external-side and a center-side, the external-side gravel has an average particle diameter of 1 cm or more and 5 cm or less, the center-side gravel has an average particle diameter of 2 cm or more and 10 cm or less, and the center-side gravel is larger in average particle diameter than the external-side gravel.

11. The water collecting structure according to claim 3, further comprising:

a water conveying wall that is located on an upstream side of the water shield wall and is made of dry masonry gravel so as to have a lower end in contact with the water conveying belt portion.

12. The water collecting structure according to claim 6, wherein in the gravel of the vertical drain hole portion having an external-side and a center-side, the external-side gravel has an average particle diameter of 1 cm or more and 5 cm or less, the center-side gravel has an average particle diameter of 2 cm or more and 10 cm or less, and the center-side gravel is larger in average particle diameter than the external-side gravel.

13. The water collecting structure according to claim 9, wherein in the gravel of the vertical drain hole portion having an external-side and a center-side, the external-side gravel has an average particle diameter of 1 cm or more and 5 cm or less, the center-side gravel has an average particle diameter of 2 cm or more and 10 cm or less, and the center-side gravel is larger in average particle diameter than the external-side gravel.

14. The water collecting structure according to claim 13, wherein the water conveying wall has two layers including a layer made of upstream-side gravel and a layer made of downstream-side gravel, and the upstream-side gravel has an average particle diameter of 5 cm or more and 15 cm or less, the downstream-side gravel has an average particle diameter of 10 cm or more and 20 cm or less, and the downstream-side gravel is larger in average particle diameter than the upstream-side gravel.

15. The water collecting structure according to claim 10, wherein the upper surface of the water repellent sand layer is configured such that a boundary surface, viewed from a downstream side of the water repellent sand layer, with the water conveying belt portion provided between the water repellent sand layer and the first soil layer has a pair of slanted surfaces that are slanted in a V shape with respect to the water conveying belt portion.

16. The water collecting structure according to claim 1, wherein the water conveying wall has two layers including a layer made of upstream-side gravel and a layer made of downstream-side gravel, and the upstream-side gravel has an average particle diameter of 5 cm or more and 15 cm or less, the downstream-side gravel has an average particle diameter of 10 cm or more and 20 cm or less, and the downstream-side gravel is larger in average particle diameter than the upstream-side gravel.

17. The water collecting structure according to claim 1, wherein the upper surface of the water repellent sand layer is configured such that a boundary surface, viewed from a downstream side of the water repellent sand layer, with the water conveying belt portion provided between the water repellent sand layer and the first soil layer has a pair of slanted surfaces that are slanted in a V shape with respect to the water conveying belt portion.

18. The water collecting structure according to claim 1, wherein the gravel layer in the water conveying belt portion has at least two layers including an upper gravel layer and a lower gravel layer, the gravel in the lower gravel layer has an average diameter of 5 cm or more and 15 cm or less, the gravel in the upper gravel layer has an average diameter of 10 cm or more and 20 cm or less, and the gravel in the upper gravel layer is larger in average diameter than the gravel in the lower gravel layer.

* * * * *